US007525112B2

(12) United States Patent
Engelhardt

(10) Patent No.: US 7,525,112 B2
(45) Date of Patent: Apr. 28, 2009

(54) METHOD AND APPARATUS FOR PERMANENT AND SAFE DISPOSAL OF RADIOACTIVE WASTE

(76) Inventor: Dean Stewart Engelhardt, 404 N. Danehurst Ave., Covina, CA (US) 91724

( * ) Notice: Subject to any disclaimer, the term of this patent is extended or adjusted under 35 U.S.C. 154(b) by 208 days.

(21) Appl. No.: 11/566,687

(22) Filed: Dec. 5, 2006

(65) Prior Publication Data

US 2007/0090306 A1 Apr. 26, 2007

Related U.S. Application Data

(63) Continuation-in-part of application No. 10/365,205, filed on Feb. 11, 2003, now abandoned.

(60) Provisional application No. 60/355,620, filed on Feb. 11, 2002.

(51) Int. Cl.
*G21F 5/00* (2006.01)

(52) U.S. Cl. ..... 250/506.1

(58) Field of Classification Search ..... 250/506.1, 250/505.1

See application file for complete search history.

(56) References Cited

U.S. PATENT DOCUMENTS 5,015,863 A * 5/1991 Takeshima et al. ..... 250/515.1

* cited by examiner

*Primary Examiner*—Kiet T Nguyen
(74) *Attorney, Agent, or Firm*—Angus C. Fox, III

(57) ABSTRACT

A method of disposing of radioactive waste comprising the steps of: providing a pressure-equalizing container; filling the pressure-equalizing container with radioactive waste; and burying the waste filled container in a subduction fault region of the earth's crust. For a preferred embodiment of the process, the waste filled containers are buried in the mud on the ocean floor in a subduction fault region. Preferably, the containers are placed on the ocean side of the fault, rather than the continental shelf side. The pressure-equalizing container is preferably fabricated from stainless steel, with a lead seal, although containers fabricated from ceramic materials may also be used. The waste-filled containers are transported by ship to the area above a subduction fault, and an unpressurized, remote-controlled "submarine crawler" takes a number of containers to the ocean floor and buries them there, individually, in the mud or sediments.

11 Claims, 8 Drawing Sheets

ITEM 10

ITEM 10

METHOD AND APPARATUS FOR PERMANENT AND SAFE DISPOSAL OF RADIOACTIVE WASTE

This application is a continuation-in-part of application Ser. No. 10/365,205 which was filed on Feb. 11, 2003 now abandoned and titled Method and Apparatus for Permanent and Safe Disposal of Radioactive Waste, and which has a priority date based on Provisional Patent Application No. 60/355,620, which has a filing date of Feb. 11, 2002.

BACKGROUND OF THE INVENTION

1. Field of the Invention

This invention relates to the apparatus for permanently disposing of high and low-level nuclear waste in subduction faults in oceans.

2. Description of the Prior Art

One of the primary problems associated with the generation of electrical power via nuclear fusion is the disposal of radioactive waste. Uranium-fueled, light-water reactors, which are commonly used in the U.S., produce plutonium 239 as one of the waste byproducts. Not only is plutonium 239 extremely poisonous, it has a half-life of 24,400 years. That means that this element would be dangerous to man for about a quarter of a million years.

Retrieval of high-level nuclear waste by terrorists is another potentially grave problem. Sophisticated terrorists may separate the plutonium from the waste in order to build thermonuclear weapons. Less sophisticated terrorists may simply use the high-level waste to build a dirty conventional bomb.

Proposals for disposing of nuclear waste have included embedding the waste in a plastic binder and burying it, storing it above and below ground in special canisters and/or vaults, and encasing the material in a leakproof material and dropping it to the ocean floor. It has even been proposed that high-level nuclear waste be loaded aboard rockets and sent into outer space.

None of these proposals provide safe permanent storage of the radioactive material. Nor are terrorists prevented from retrieving stored material. Any conventional disposal site will require round-the-clock security. What is needed is a disposal method and equipment that is both safe and permanent and, due to the nature of the process, will not require any further security once the waste has been packaged and placed.

SUMMARY OF THE INVENTION

A primary object of the present invention is to provide a method for safe disposal of high and low-level radioactive waste. Radioactive waste is loaded into special containers and placed in suitable subduction zone locations where it will never be a hazard to life on the planet. Suitable subduction zones include the Aleutian Trench, the Juan De Fuca trench, the Peru-Chile Trench, the Kurile Trench, the Mariana Trench, the Ryukya Trench, the New Hebrides Trench, the Tonga Trench, the Kermadec Trench, and the Java Trench. The other two subduction zones-one in the Near East and the other on the China-India border-are not considered useful disposal locations, as they are not on an ocean floor and will not provide the same level of security as those subduction zones which are on an ocean floor.

It is hypothesized that the majority of the internal heat of this planet comes from radioactive decay below the earth's crust. Therefore, placing the waste below the earth's crust will have no measurable effemct on the earth's interior temperature. The capacity of the earth's core is so vast as to be limitless for all practical purposes.

The earth's interior has slow-moving currents of molten rock in its mantle that move in a direction toward the center of the earth in the vicinity of subduction zones. These currents will carry the containers down through the mantle until the currents slowly turn parallel to the surface of the earth's outer core. As the outer core is liquid iron, the radioactive waste will drop relatively quickly through this zone to the inner core until it lands on the surface of the inner core. That is where the waste will remain.

These subduction faults provide a natural pathway for nuclear waste disposal with an increase in safety and security, at a fraction of the cost over the long term, as compared to the storage methods now being used and considered.

Another primary objective of the present invention is to provide a disposal container that is designed for burial in sediment on the ocean floor near a subduction zone.

To eliminate the possibility of leakage, the container must be of a pressure-equalizing design. These disposal containers are designed to be filled with high- or low-level radioactive waste, transported to the ocean floor next to a subduction zone, and buried in the mud. A key feature of the hardware is the ability to compensate for extreme increases in pressure without damage to the container. This is accomplished by creating a container that is essentially a piston within a cylinder, whereas the piston is free to move into the cylinder as far as necessary to equalize the pressures within and without. Some resistance to the equalization of pressures will occur as the spent fuel rods resist compression, but cuts made in the fuel rod bundles will cause their collapse within a certain delta of pressure. This has the advantage of insuring that any leak travels from outside to inside the container—therefore no contaimination external to the container will occur in the event of damage to the container or manufacturing flaw.

Another primary objective of the present invention is to provide a method for transporting filled disposal containers to a subduction zone region. The method involves utilizing an unpressurized "submarine crawler" that can carry a number of containers and bury these in sediments on the sea floor. Once the containers are buried, this completes any action needed to completely eliminate them as a danger or hazard, as it they will be drawn slowly via tectonic forces at the subduction zone into the earth's serpentized mantle, and then into the mantle of the interior of the earth. Once there, the containers are unable to the surface due to the mass of the radioactive waste, which is considerably greater than that of the surrounding rock. Over many thousands of years, the containers will settle toward the earth's outer core due to local earthquake activity shaking the surrounding rock. Eventually, the waste will come to rest on the outer surface of the inner core of the earth.

DETAILED DESCRIPTION OF THE INVENTION

The invention will now be described in detail with reference to the attached drawing figures. It should be understood that the drawings are meant to be merely illustrative and are not necessarily drawn to scale.

Figure 1:
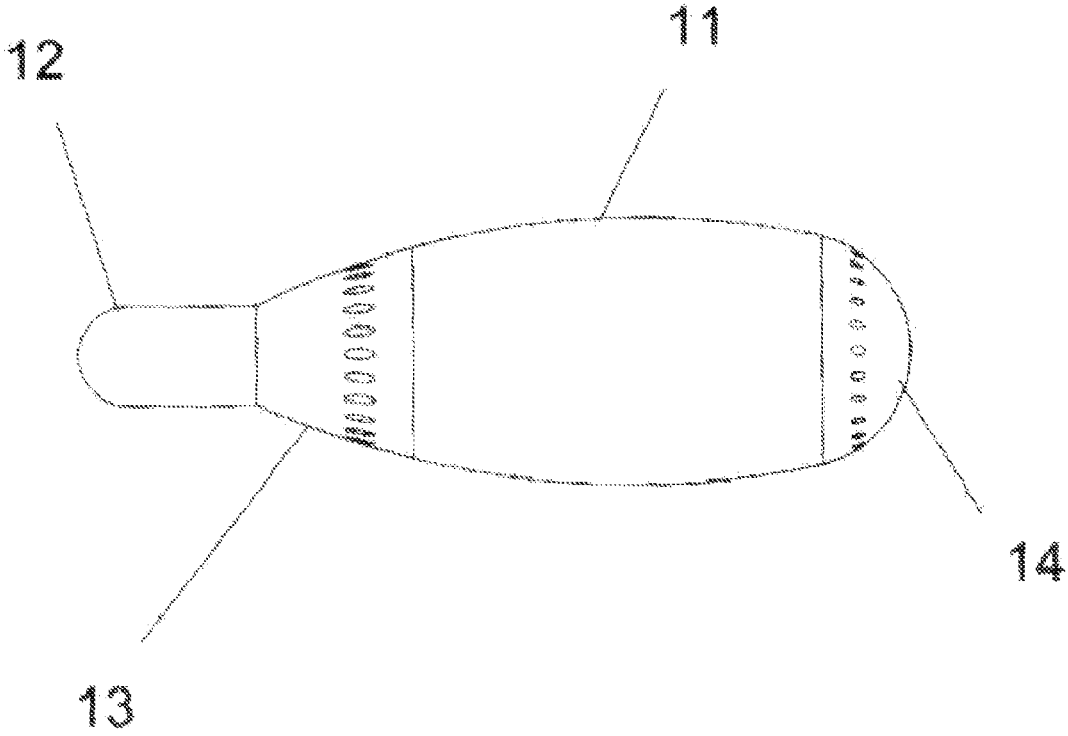
FIG. 1 is an overall view the complete container assembly.
Figure 2:
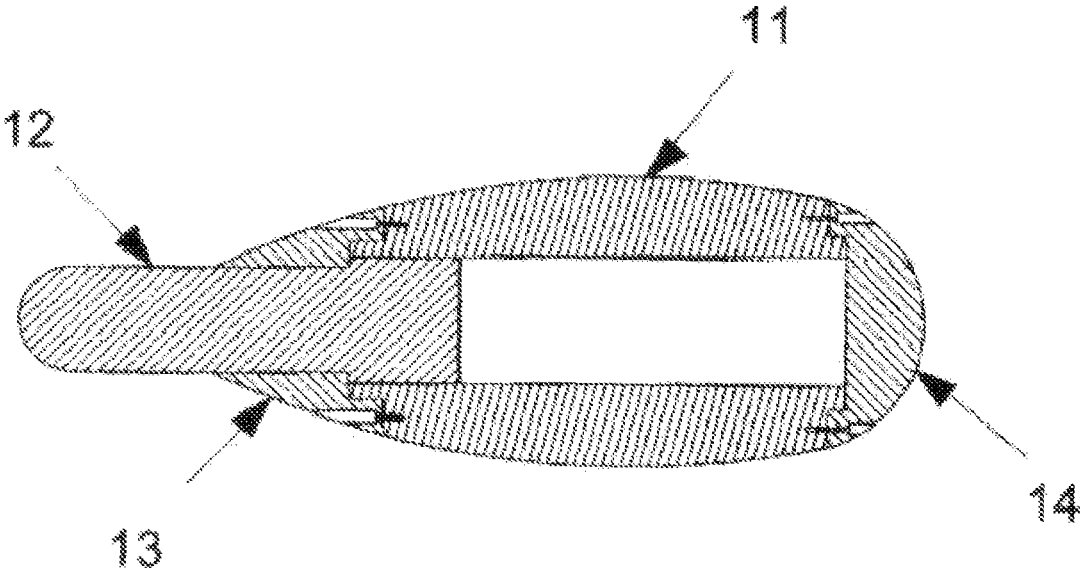
FIG. 2 is a cutaway view of the container assembly.
Figure 3:
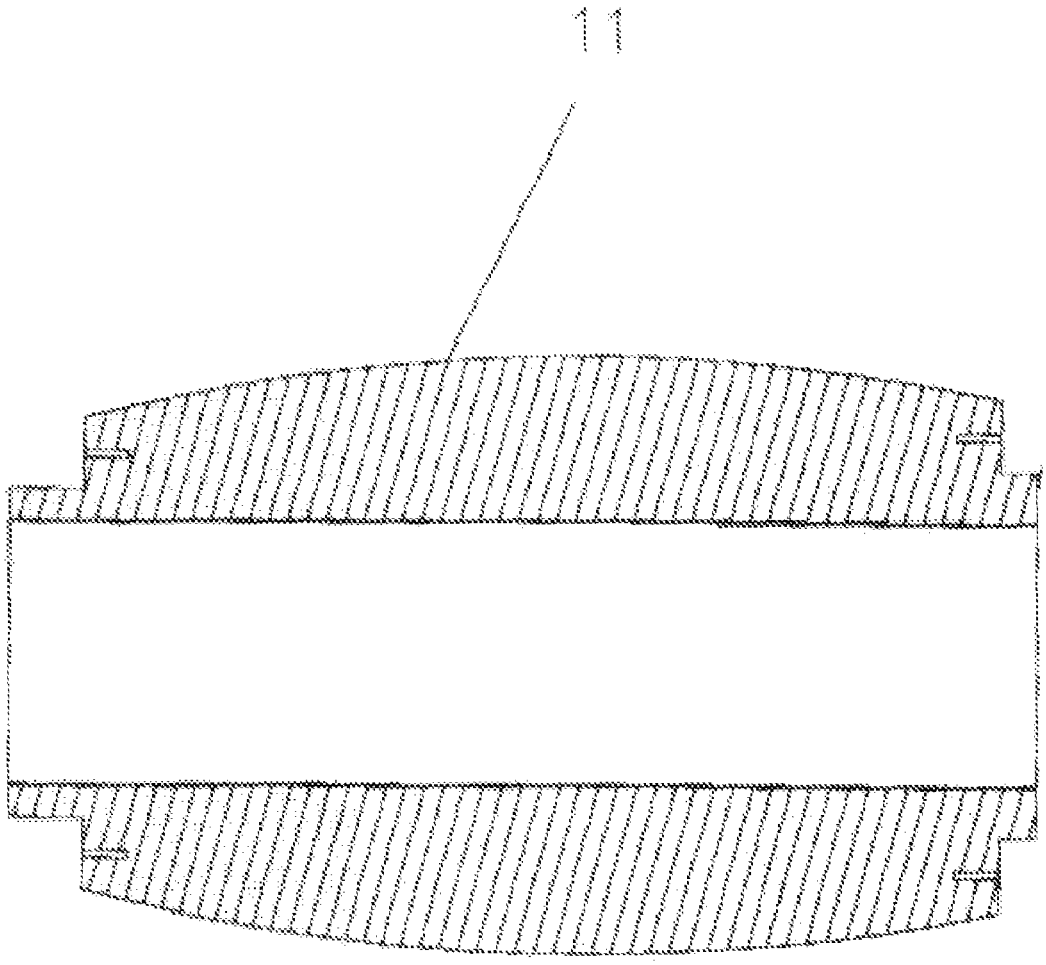
FIG. 3 is a cutaway view of the chamber body.
Figure 4:
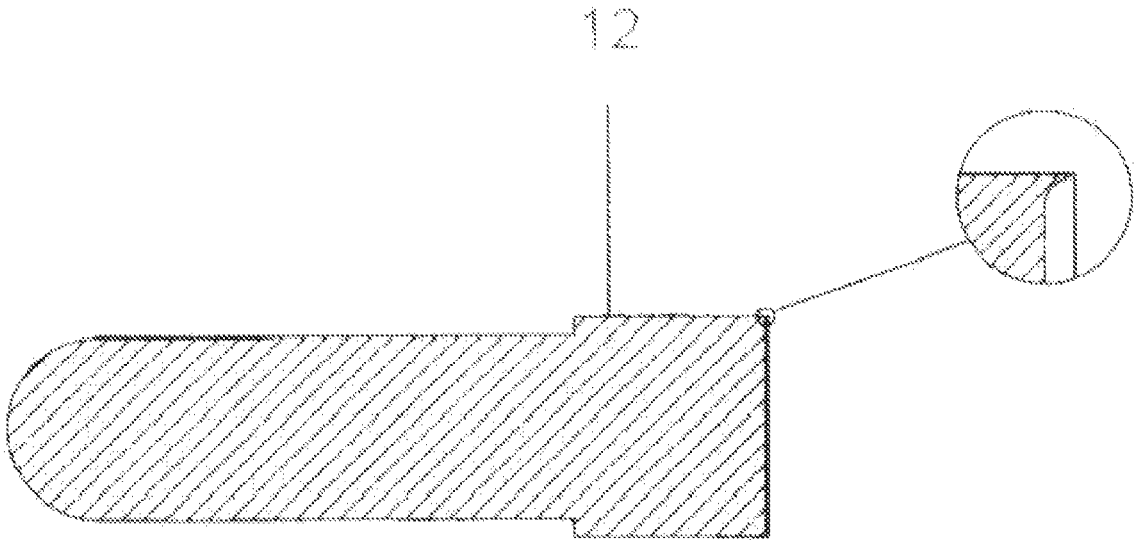
FIG. 4 is a cutaway view of the piston plug—included is a detail of the scraper.
Figure 5:
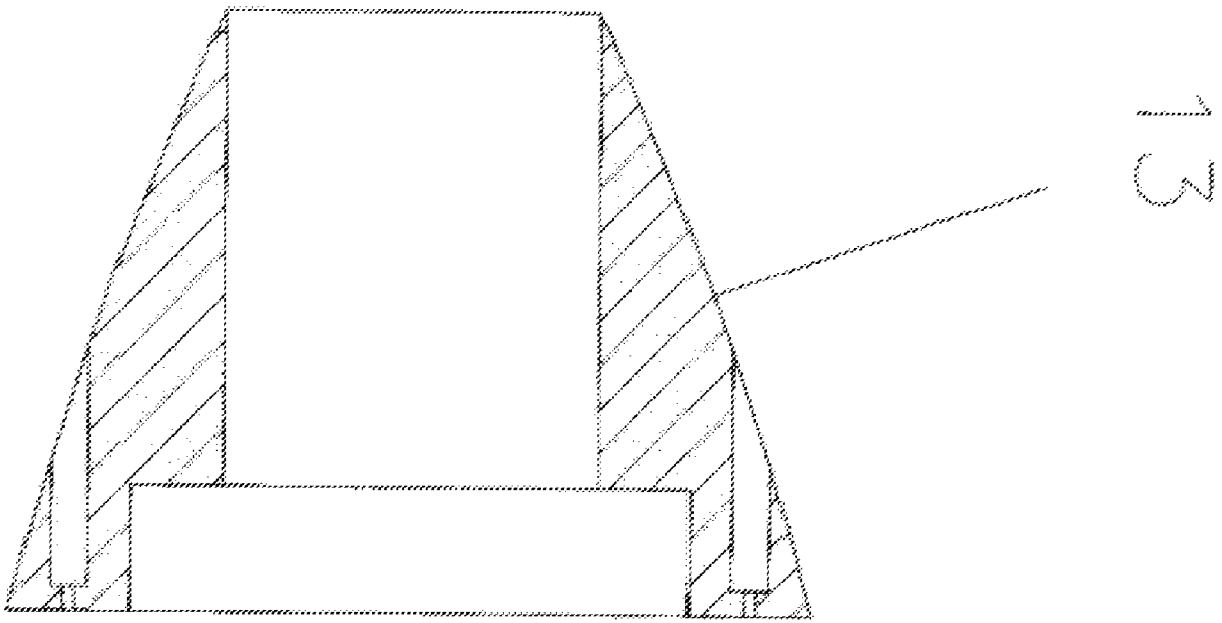
FIG. 5 is a cutaway view of Item 13, the collar.
Figure 6:
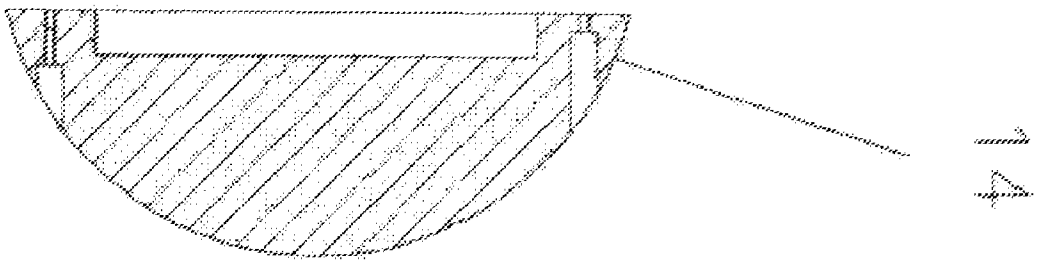
FIG. 6 is a cutaway view of Item 14, the end cap.
Figure 7:
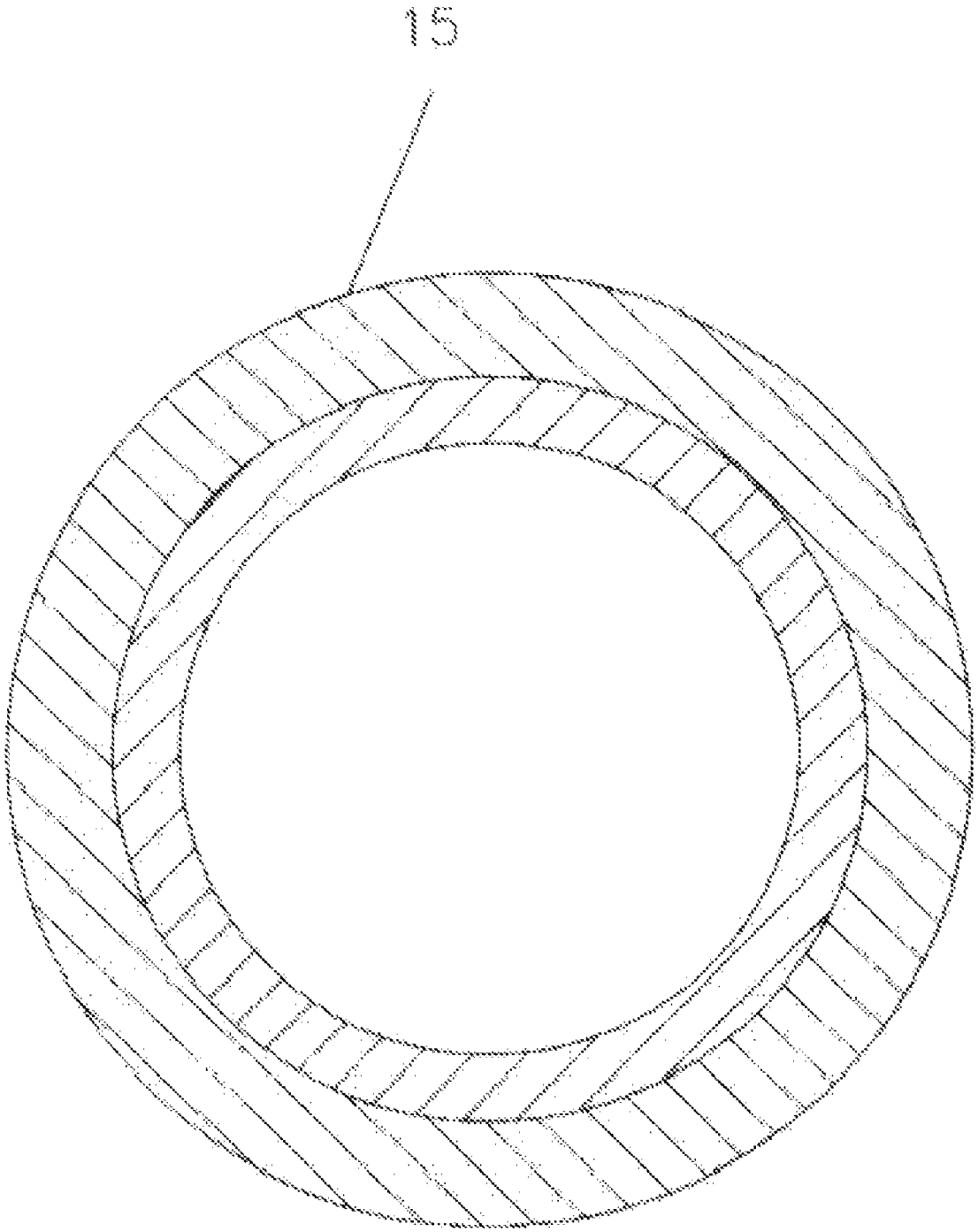
FIG. 7 is a cutaway view of Item 15, an O-ring.

Referring now to FIG. 1, the present invention is designed to provide the nuclear power industry and other organizations that generate nuclear waste, including both low- and high-level waste, with a special container 10 for nuclear waste disposal. This container resists increasing temperatures by being made of stainless steel or other suitable material. Stainless steel starts to soften at 1100° C. and melts at 1400°-1500° C. Other materials may be used provided that the melting point is greater than that of stainless steel. Ceramic materials, for example, are a usable alternative to stainless steel. The container 10 includes a chamber body 11 having a cylindrical inner chamber; a piston plug 12 which slides within the cylindrical inner chamber, thereby compensating for increasing external pressures; a piston-plug retaining collar 13 which bolts to an upper end of the chamber body 11; and a bottom end cap 14, which bolts to and seals a lower end of the chamber body 11.

Still referring to FIG. 1, the chamber body 11, which is the primary structure of the container 10, is thick-walled and generally axially symmetrical, having a large axially-aligned cylindrical inner chamber and a pronounced convex outer surface. The inside surface of the cylindrical inner chamber is coated with a layer of lead and then a layer of copper or other suitable material. The uppermost portion of the cylindrical inner chamber is slightly beveled so that when the piston plug 12 is installed within the cylindrical inner chamber, the copper and lead coating is partially peeled away as the piston plug enters the inner chamber. The piston plug 12 is a solid cylinder, rounded on the upper exposed end and having a generally flat piston shape to the opposite end which is inserted into the inner chamber during assembly. On the perimeter of the surface of the piston end is a curved cutting edge machined into the piston which is designed to scrape the lead and copper as the piston plug 12 moves further into the cylindrical inner chamber of the chamber body 11. The collar 13 bolts directly to the chamber body 11 and it locks the piston plug 12 within the chamber body 11. The end cap 14 is bolted to the lower end of the chamber body 11. During assembly, the end cap 14 is bolted to the lower end of the chamber body 11, the cylindrical inner chamber is filled, the piston plug 12 is installed, and the collar 13 is bolted to the upper end of the chamber body 11. Lead and copper O-rings filled with nitrogen can be used to provide an all-metal seal between the mating surfaces of the chamber body 11, the end cap 14, and the collar 13.

Figure 8:
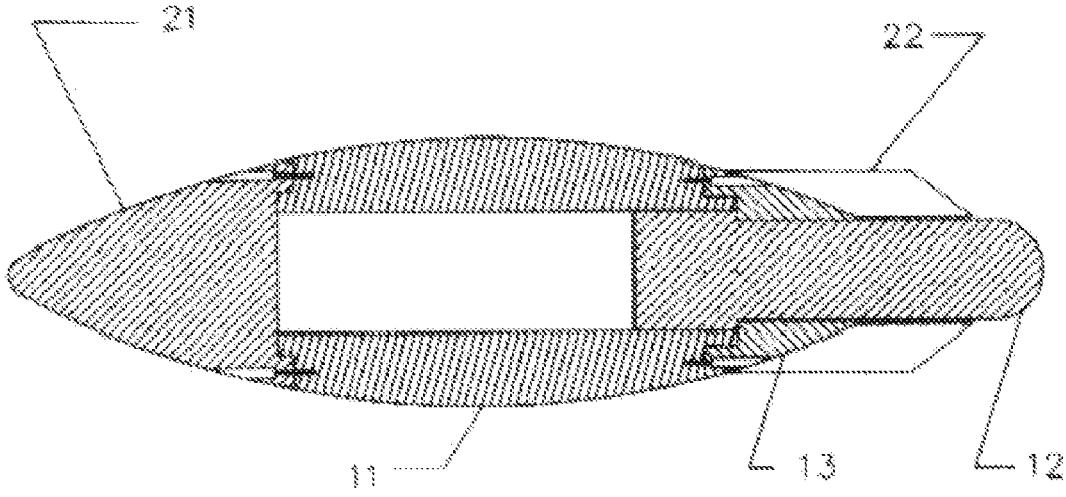
FIG. 8 is a cutaway view of the alternative free-drop version of the container; this view includes the penetrator endcap and the tail fin.

Referring now to FIG. 8, an alternative free-drop container 20 is identical to the container 10 of FIG. 1, with two exceptions. Firstly, a penetrator end cap 21 replaces the end cap 14, bolting to the chamber body 11 in a like manner. The penetrator end cap 21 is shaped facilitate ground penetration at the end of the free-drop descent to the ocean bottom. Secondly, multiple tail fins 22, which can be mounted on the collar 13, are used to stabilize the descent of a free-dropped container 20.

A preferred embodiment of the radioactive waste disposal process begins with the filling of the disposal containers with nuclear waste.

The second step of the radioactive waste disposal process is the transport of the containers by ship or barge to pre-selected locations at a subduction fault zone on the ocean floor. Suitable subduction fault zones include the Aleutian Trench, the Juan De Fuca trench, the Peru-Chile Trench, the Kurile Trench, the Mariana Trench, the Ryukya Trench, the New Hebrides Trench, the Tonga Trench, the Kermadec Trench, and the Java Trench.

The third step of the radioactive waste disposal process is burying the containers. A mother ship sends a remote-controlled submarine crawler with the containers down to the sediments at the bottom of the ocean over the fault. The crawler drills a hole in the mud for each container that is about 15-20 feet, plus the length of the container, deep, then drops a container into each hole. A covering of 15-20 feet of mud is sufficient mud to eliminate any trace of a radioactive signature at the burial site. Thus any nearby marine life will be protected. In order to avoid violation of international treaties, the disposal container is sealed inside a flexible polymeric covering so that the container, itself, is never in contact with the ocean environment during transit above and in the ocean.

Burying the waste disposal container in a shallow hole is preferable to merely placing it on the seabed, although a free-drop container, having a penetrating end cap and stabilizing fins may be dropped from a surface ship. The layer of mud is advantageous because it protects the radioactive waste disposal container from the corrosive effects of seawater. The preferred material for the container is deemed to be stainless steel, but it can be made from a variety of materials, including ceramics. The mud also has the advantage of making retrieval by terrorists almost impossible. The mud makes it difficult both to locate and to extract the container from the seabed. Grappling and retrieving the rounded surface of the proposed container would be extremely difficult, and would require a major engineering effort.

Once buried in mud, all support activity ceases other than general surveillance coverage of the broad area in which the containers rest. The amount of effort needed to even attempt to find and recover one of these containers would be huge and easily noticed by remote surveillance. The containers will quickly (geologically speaking) descend to the ocean bedrock and gradually be drawn into the subduction fault by the subducting motion of the oceanic bedrock. Being located in compressed clays and gravel, the containers will continue to travel downward at a faster rate than the surrounding sediments due to their greater mass. (Once in the earthquake zone, even a failure of the container will not release any radiation toward the surface as it will already be under the overhanging continental crust.) Nothing can reverse this process. The containers are drawn down, first, into the serpentized mantle, and then into the mantle, until the heat of the earth's interior starts to soften the metal of the containers in about 6 million years. When the metal fails, the released radioactive waste is carried still further down into the earth's mantle. After melting, the radioactive waste settles down through the mantle and through the outer core until it settles on the mountains of the inner core. Long before this happens, the radioactivity within the containers will drop to such a low level at a much shallower location, as to not be dangerous to anyone.

Burying disposal containers filled with radioactive waste in holes drilled on the ocean floor in the mud adjacent to a subduction fault is a relatively economical process. A more detailed description of the drilling and insertion process will now be provided.

The robot submarine seabed crawler can be roughly compared to a gigantic skeletonized Army battle tank without the turret but with an oil drilling rig in its place. The crawler has a pair of caterpillar treads similar to those of a tank. That is to say that each tread consists of a continuous roller belt running over cogged wheels. The drilling rig is positioned between the two treads. The crawler may incorporate ballast tanks which enable the machine to descend and ascend in water at a controlled rate. The crawler also serves as a dispenser magazine for multiple radioactive waste disposal containers.

A vacuum assembly on the crawler draws mud and sediments into the central axis shaft during the drilling. When the drilling is finished, the drill bit and container are released and the drill/insertion shaft is retracted, the sediments that were drawn into the central axis shaft are now allowed to dump into the hole, burying the container.

The shape of the disposal container (Items 10 or 20) allows it to slip from a high pressure area to a lower one as it travels through the sediments in a subduction fault region. The movement is analogous to squeezing a watermelon seed. There are no external projections on the container that might cause it to snag on the rock surrounding it. The preferred material of all parts except the lead and copper seal is stainless steel. Other materials may be used, depending upon specifications. Earthquake activity is the driving force that will propel the containers toward the earths center.

The procedure of burying disposal containers filled with radioactive waste includes a number of steps.

The first step is to identify an appropriate subduction fault in which to plant the containers. For example, the Aleutian Trench is approximately 1800 miles long by 150 miles wide, providing a huge amount of undersea real estate suitable for buried containers. All ocean-bottom subduction faults are suitable as disposal sites. Two major subduction faults are located on landmasses, one in the Middle East and the other in the area forming the border region between China and India. These are not suitable waste disposal sites due to (a) accessibility by terrorists and (b) the lack of immediate increase in pressure on the containers to maintain a tight seal.

The second step is that of loading nuclear waste into a disposal container. This would most safely be performed at reactor sites.

The third step is that of transporting the container to a port equipped with a mother ship. The preferred method would be by water, because if an accident were to occur, submergence in water would strengthen the container. Also, the surrounding water would act as an efficient shield, allowing time for recovery and blockading unauthorized water craft from the accident site.

The fourth step is that of transporting the containers to a subduction fault on the mother ship, which carries a submarine seabed crawler. Each of a plurality of filed disposal containers is married to a disposable drill bit and then loaded on the submarine seabed crawler. The mother ship then travels to a subduction fault where it lowers the unmanned submarine seabed crawler to the sea floor. This is usually at a depth of between 5 and 7 miles.

The fifth step involves selection of a drill bit/container assembly and connection of the drill-bit/container assembly to the drill/insertion shaft with automatic quarter-turn bolts.

The sixth step involves drilling a hole in the sea floor sediments using the drill/insertion/container assembly. As the hole is drilled, the sediments are vacuumed into the interior of the axis shaft. When the proper depth is reached, the drill bit is released by reversing the quarter-turn bolts, which also releases the container. As the shaft is being retracted from the hole, the sediments in the center of the shaft are free to bury the container and the discarded drill bit. Once the drill/insertion shaft is completely retracted, it cycles onto another container pre-packaged with another drill bit, locks onto the new drill bit and the cycle repeats itself.

What is claimed is:

1. A pressure-equalizing container for storing radioactive waste in sediments on the ocean floor at a subduction fault, said container comprising:

a chamber body having a generally cylindrical interior and a convex exterior;

a piston plug movable within the cylindrical interior;

a collar which captures the piston-plug and is affixed to one end of the chamber body;

an end cap which is attached to the other end of the chamber body to seal in the radioactive waste;

a soft metal liner coating the generally cylindrical interior of the chamber body, said liner coating becoming a traveling sealant as external pressures increase; and one or more all-metal O-rings to provide a seal between the chamber body and the end cap.

2. The pressure-equalizing container of claim 1, wherein said chamber body has a convex external surface.

3. The pressure-equalizing container of claim 1, wherein said soft metal liner is fabricated primarily of lead.

4. A pressure-equalizing container for storing radioactive waste in sediments on the ocean floor at a subduction fault, said container comprising:

a chamber body having a cylindrical interior coated with a layer of lead, and sealed at a lower end thereof;

a piston plug having a solid cylindrical piston having a first diameter, and a solid cylindrical plug having a second diameter that is less than said first diameter, said cylindrical piston and said cylindrical plug being both unitary and coaxial, said piston being installable within an upper portion of said cylindrical interior after said cylindrical interior is partially filled with radioactive waste, said piston having a curved, sharpened circular lower edge designed to scrape lead from the cylindrical interior as the piston plug moves further into said cylindrical inner chamber of said chamber body under external pressure;

a collar having a cylindrical aperture that is less than said first diameter, but greater than said second diameter, said collar being securable to an upper end of the chamber body following installation of the piston plug therein, said collar thereby acting to capture the piston of said piston-plug so that it cannot be removed from said cylindrical inner chamber.

5. The pressure-equalizing container of claim 4, which further comprises a coating of copper covering the layer of lead.

6. The pressure-equalizing container of claim 4, wherein the lower end of said cylindrical interior is sealed with an end cap that is bolted to a lower end of said chamber body.

7. The pressure-equalizing container of claim 6, wherein said end cap is pointed to facilitate penetration into sediments on the ocean floor at the subduction fault.

8. The pressure-equalizing container of claim 6, which further comprises fins attached to an upper portion of said container, said fins acting to stabilize descent of said container to sediments on the ocean floor at the subduction fault.

9. The pressure-equalizing container of claim 4, wherein an upper end of said plug is hemispherical.

10. The pressure-equalizing container of claim 4, wherein said piston, in combination with said lead layer, acts to seal the upper portion of said cylindrical interior.

11. The pressure-equalizing container of claim 4, wherein an upper portion of said cylindrical interior is conically beveled so as to faciliate initial entry of the piston into the cylindrical interior.

* * * * *